United States Patent [19]

Wu

[11] Patent Number: 4,916,998

[45] Date of Patent: Apr. 17, 1990

[54] ELECTRIC SWITCH AND INTEGRATED SWITCH-PREACCELERATOR SYSTEM FOR AN ELECTROMAGNETIC PROJECTILE LAUNCHER

[75] Inventor: Jiing-Liang Wu, Murrysville Borough, Pa.

[73] Assignee: Westinghouse Electric Corp., Pittsburgh, Pa.

[21] Appl. No.: 209,816

[22] Filed: Jun. 22, 1988

[51] Int. Cl.[4] ..... F41F 1/02

[52] U.S. Cl. ..... 89/8; 124/3; 200/82 R; 200/148 G

[58] Field of Search ..... 89/8; 124/3; 200/82 R, 200/82 B, 148 B, 148 G; 310/11, 12

[56] References Cited

U.S. PATENT DOCUMENTS

| | | | |
|---|---|---|---|
| 3,474,339 | 10/1969 | Rioux | 310/11 |
| 3,941,957 | 3/1976 | Tilman | 200/82 R |
| 4,215,253 | 7/1980 | Tilman | 200/82 R |
| 4,644,119 | 2/1987 | Wu | 200/144 R |
| 4,683,353 | 7/1987 | Wu et al. | 200/8 R |
| 4,727,230 | 2/1988 | Wu | 200/144 R |

OTHER PUBLICATIONS

Upshaw et al., "A Coaxial Radial Opening Switch for a Distributed-Energy-Stove Rail Launcher", IEEE Transactions on Magnetics, Mar. 1984, pp. 320-323.

*Primary Examiner*—Stephen C. Bentley
*Attorney, Agent, or Firm*—D. Schron

[57] ABSTRACT

An integrated switch-preaccelerator system for use in an electromagnetic launcher includes a pair of spaced generally parallel preaccelerator rails, a pair of spaced first and second conductive switch terminal elements disposed adjacent upstream ends of the rails, and three coaxially arranged conductive tubular members enclosing and extending axially along the rails, one of which being movable relative to the others between conducting and non-conducting positions. The terminal elements and selected ones of the tubular members are electrically connected together such that movement of the one tubular member from its conducting position to non-conducting position causes operation of the switch to commutate current from a first path wherein current flows from the first to the second terminal element by flowing through the tubular members in opposite directions along path segments spaced from and coaxially arranged about one another to a second path wherein current flows from the first to the second terminal element by flowing through portions of the rails and a solid armature being supported therebetween and bypassing the tubular members.

25 Claims, 5 Drawing Sheets

ELECTRIC SWITCH AND INTEGRATED SWITCH-PREACCELERATOR SYSTEM FOR AN ELECTROMAGNETIC PROJECTILE LAUNCHER

BACKGROUND OF THE INVENTION

1. Field of the Invention

The present invention relates generally to current switching and, more particularly, is concerned with an electric switch and integrated switch-preaccelerator system used to switch very large direct currents such as required for electromagnetic launching of projectiles.

2. Description of the Prior Art

One well-known type of electromagnetic projectile launcher includes a pair of generally parallel conductive launching rails, a sliding armature for conducting current between the rails and propelling a projectile along the rails, a source of direct current, and a switching system for directing current from the current source to the projectile launching rails. The current source employed by the launcher is a serially connected direct current homopolar generator and inductive energy storage device. This current source is connected to the breech ends of the pair of projectile launching rails. The switching system is required to perform power compression duty. It provides a low loss conductive path for current flow during charging of the inductive energy storage device and commutates the current to the rail load within the preselected time interval Typically, the switching system includes an opening switch movable between opened and closed positions relative to the breech ends of the rails. When the opening switch is in its closed position, it shorts across the breech ends of the rails and establishes a low resistance path for current flow from the homopolar generator to charge the inductive energy storage device. After charging the device to the desired level, the opening switch is opened to commutate current into the projectile launching rails and through the sliding armature positioned between the rails to place a high acceleration force on the associated projectile.

Therefore, the functions performed by the opening switch include: providing, in the closed position, a low resistance path for current flow during the charging of the inductive energy storage device; and commutating, within a short time interval of typically less than one millisecond, the current flow into the conductive rail load. In repetitive firing launchers, these functions must be performed in rapid succession.

For practical launchers, the peak current that must be commutated is on the order of several hundred thousand to several million amperes, the required commutation time is about 1 millisecond or less and the inductive energy storage has an inductance of a few microhenries. If a low-voltage device such as the homopolar generator is used as the prime power supply for charging the inductive energy storage device, a charging time of several tens to several hundreds of milliseconds is required. This produces a very high accumulated amp$^2$-second ($I^2t$) during the inductor charging phase, for instance $10^{11}$ amp$^2$-second. Furthermore, to commutate current to the load, a high and rapidly rising switch voltage, on the order of a few kV in less than 1 millisecond, may be required. The required performance parameters, that is, high peak current, long inductor charging time, high accumulated $I^2t$ and high commutation voltage, create conflicting demands on the switch design and are the critical factors to be considered.

Some of these performance parameters and other problems which arise in launchers of this type have been addressed in several U.S. Pat. Nos. to Wu et al. (4,644,119; 4,683,353; and 4,727,230), all of which are assigned to the assignee of the present invention. Notwithstanding the overall advantages to be derived from the approaches of these patents, it is perceived that a need still remains for a different approach to improving switching system performance in an electromagnetic launcher.

SUMMARY OF THE INVENTION

The present invention provides an electric switch and an integrated switch-preaccelerator system designed to satisfy the aforementioned needs. The approach of the present invention to resolving the critical problems of electromagnetic launcher (EML) switching is to reduce the switching severity based on a systems perspective. Specifically, this approach reduces significantly the level of switch voltage required for current commutation to load by eliminating or reducing the main contributing factors of the voltage requirements.

The result of this approach is the electric switch and integrated switch-preaccelerator system of the present invention. The switch is composed of three concentrically and coaxially arranged conductor tubes providing a coaxial switch configuration and the switch-preaccelerator system is basically an integration of the switch with a rail gun type preaccelerator. The switch commutates current into an essentially stationary solid projectile armature in the preaccelerator breech. The armature is accelerated to the required preacceleration speed and then vaporized to form a plasma armature before entering the main EML breech. By this arrangement, and by using a coaxial switch configuration, the commutation voltage requirement is reduced substantially. Reduction of commutation voltage requirement significantly reduces switching severity and increases the life and thus the feasibility of mechanical switch usage for EML opening switch applications. Additional advantages include the relaxation of the operation timing requirement, shorter preaccelerator barrel length, and more compact and lightweight design.

Accordingly, the present invention is directed to an electric switch, comprising: (a) a pair of spaced first and second conductive terminal elements; and (b) a plurality of coaxially arranged conductive tubular members, one of which being movable relative to the others between conducting and non-conducting positions. The terminal elements and selected ones of the tubular members are electrically connected together such that movement of the one tubular member from its conducting position to non-conducting position causes operation of the switch to commutate current from a first path wherein current flows from the first terminal element to the second terminal element by flowing through the tubular members in opposite directions along path segments spaced from and coaxially arranged about one another to a second path wherein current flows from the first terminal element to the second terminal element by flowing through a load, bypassing the tubular members. In particular, the plurality of tubular members includes inner, outer and middle conductor tubes concentrically and coaxially arranged with one another.

Also, the present invention is directed to an integrated switch-preaccelerator system for use in an electromagnetic launcher. The integrated system comprises: (a) a pair of spaced generally parallel preaccelerator rails; and (b) a linear mechanical switch of cylindrical configuration enclosing and extending axially along the rails, the switch being operable to commutate current from a first path wherein current flows through the switch in opposite directions along path segments spaced from one another and coaxially arranged about the rails to a second path wherein current flows across the rails through a solid armature being supported between the preaccelerator rails.

These and other advantages and attainments of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the course of the following detailed description, reference will be made to the attached drawings in which.

DETAILED DESCRIPTION OF THE INVENTION

Figure 1:
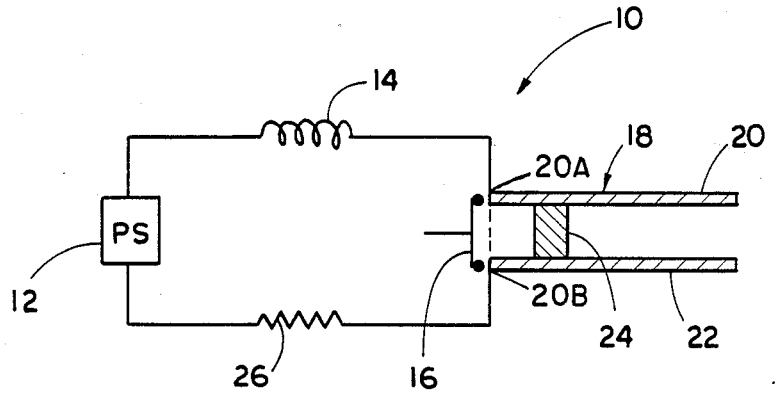
FIG. 1 is a circuit diagram of a simplified electromagnetic launcher.

In the following description, like reference characters designate like or corresponding parts throughout the several views of the drawings. Also in the following description, it is to be understood that such terms as "forward", "rearward", "left", "right", "upwardly", "downwardly", and the like, are words of convenience and are not to be construed as limiting terms.

Electromagnetic Projectile Launcher

Referring now to the drawings, and particularly to FIG. 1, there is shown a circuit diagram of a simplified electromagnetic launcher (EML), generally designated by the numeral 10. The EML 10 typically includes a homopolar generator (HPG) 12 as a power supply, an inductor 14 as an inductive energy storage device being connected in series with the power supply 12, an opening switch 16 and a launcher barrel 18 having a pair of conductive rails 20,22 upon which movably rides a projectile/armature 24. The opening switch 16 is connectable across the breech ends 20A,22A of the pair of projectile launching rails 20,22. A small resistance 26 is inserted in series with the power source 12, the inductive energy storage device 14 and the opening switch 16.

The opening switch 16 performs power compression duty by providing a low loss conductive path for current flow during charging of the inductive energy storage device 14. Then, it is used to commutate the stored current to the rail-supported projectile/armature 24 within a preselected time interval. Typically, the opening switch 16 is movable between opened and closed positions relative to the breech ends 20A,22A of the rails 20,22. When the opening switch 16 is in its closed position as depicted in dashed line form in FIG. 1, it shorts across the breech ends of the rails and establishes a low resistance path for current flow from the homopolar generator 12 to charge the inductive energy storage device 14. After charging the device 14 to the desired level, the opening switch 16 is opened, as depicted in solid line form in FIG. 1, to commutate current into the projectile launching rails 20, 22 and through the sliding projectile/armature 24 positioned between the rails to impose a high acceleration force thereon. For rep-rate operations, the switch 16 needs to be reclosed before inductor charging begins again.

Figure 2:
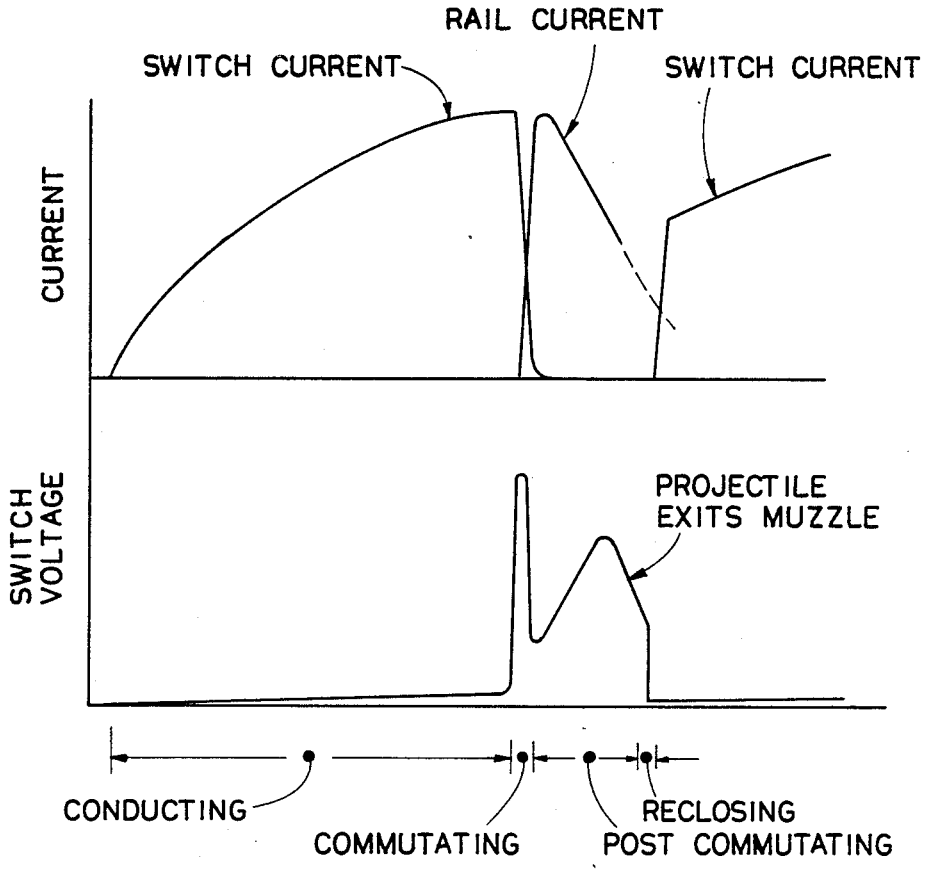
FIG. 2 is a graph showing the current and voltage transients during each phase in a switching operation in the simplified launcher of FIG. 1.

The overall performance requirements of the opening switch 16 relate to the four different phases of a switching operation or cycle: (a) conducting; (b) opening or commutating; (c) post-commutating or non-conducting; and (d) reclosing. FIG. 2 shows typical transient current flow through the switch 16 and voltage drop across the switch terminals in each of the switching phases. As can be seen, during a single switching operation or cycle, the impedance of the EML opening switch 16 changes from very low to very high values and, after a short duration, returns to its low value state when reclosed for rep-rate operations. Table I shows the ranges of switching duty and switch requirements.

TABLE I

Range of EML Operating Switch Requirements

| Phase | Switching Duty | Requirements |
|---|---|---|
| Conducting | $I^2t = 10^9 - 10^{13}\ A^2s$ (per shot) Up to 90% duty factor $I = 5 \times 10^5 - 5 \times 10^6 A$ | Mechanically sturdy Switch resistance less than or equal micro-ohms |
| Commutating | Commutate current in less than 1 ms | Generate switch voltage up to several kV or counterpulsing switch current to zero |
| Nonconducting | V = 1 to 15 kV dv/dt = 1 kV/ms | Withstand V and dv/dt without losing high impedance characteristics |
| Reclosing | V = 1 to 15 kV di/dt = 1 MA/ms | Capable of reclosing against voltage; capable of achieving the di/di rate |
| Application Switch Requirements | | |
| | Rep-rate | Very low to 50 Hz |
| | Switch life | More than a few hundred operations |

The required performance parameters of high peak current, long inductor charging time, high accumulated $I^2t$ and high commutation voltage, create difficulties or conflicts in designing an opening switch suitable for making the transition from the conducting to the commutating phase. The present invention is directed at reduction of the commutation voltage requirements as the way to resolve or reduce some of these conflicts and improving switch performance. In the next section, the factors controlling the commutation voltage requirements are examined in detail with the objective of yielding the criteria for reducing this voltage requirement. Thereafter, the integrated switch-preaccelerator system of the present invention, which incorporates these criteria, will be described in detail.

Commutation Voltage Requirements

In the commutating phase of a switching operation, the current flow through the switch 16 is forcefully reduced while the current flow along the path through the parallel rails 20, 22 and projectile 24 is increased. This can be achieved by many means, including the increasing of impedance across the switch terminals and the technique of current counter-pulsing which forces an equal magnitude but reverse current to flow through the switch. For a switch which commutates current by means of increasing impedance, the magnitude and the rate of impedance increase depends on the current, the inductance and resistance of the current commutating loop, and the desired commutation time.

Figure 3:
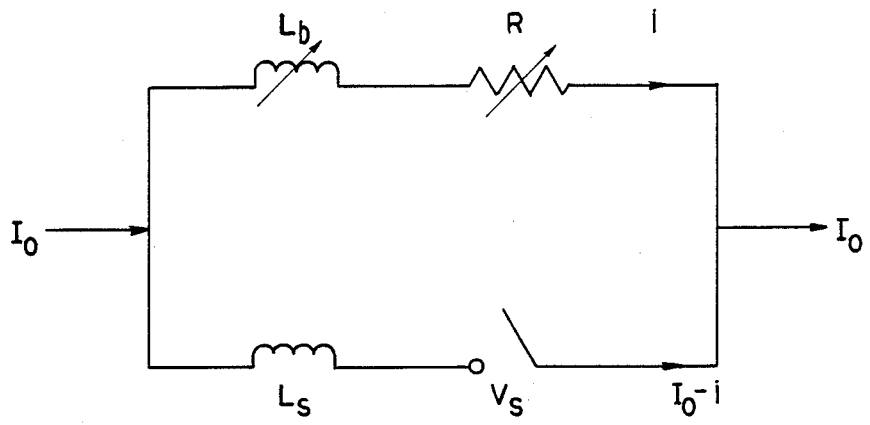
FIG. 3 is an equivalent circuit diagram of the parameters involved during the current commutation phase of the switching operation of the simplified launcher of FIG. 1.

The parameters involved during the commutating phase are shown in FIG. 3. In this equivalent circuit, "i" denotes the commutated current (i.e., the current flow through the lead), $I_o$-i is the instantaneous switch current, $L_s$ is the initial switch inductance, and $L_b$ and R are the inductance and the resistance of the load, respectively (or the instantaneous inductance and resistance of the current commutation loop). The impedance of the switch is represented by the switch voltage drop, $V_s$. For the inductive EML 10, both $L_b$ and R depend on the instantaneous projectile displacement and/or projectile speed along the rails 20,22, and thus are time varying.

Figure 4:
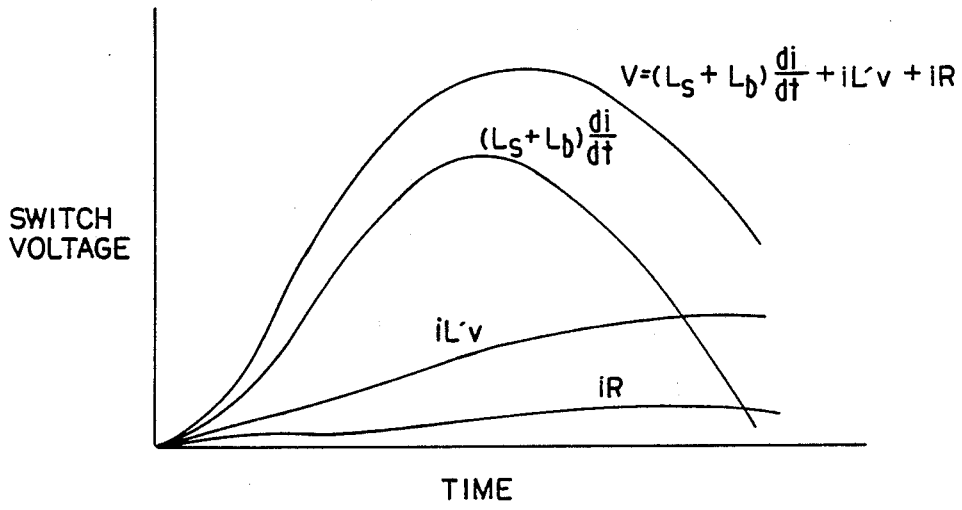
FIG. 4 is a graph showing the general relationships between switch voltage and its contributing components during current commutation phase of the switching operation of the simplified launcher of FIG. 1.

The instantaneous voltage across the switch 16 can be expressed as follows:

$$V_s = d/dt\,(iL) + iR = (L_s + Lb)di/dt + iL'v + iR \qquad (1)$$

where L' is the inductance per unit length of the barrel rails 20,22 and v is the instantaneous velocity of the projectile 24. In general, the contribution of the iR term in equation (1) is quite negligible until the very end of the current commutating phase. The iL'v term depends very much on the initial projectile velocity and the additional velocity accumulated during the current commutating phase. The $(L_s+L_b)(di/dt)$ term generally is small at the beginning and at the end of the commutation, but reaches a maximum near the mid-point of the commutating phase. The value of this maximum depends strongly on the desired current commutation time. For short commutation time, the voltage associated with this term may predominate, and thus is the controlling factor for switch design selection. FIG. 4 shows the general characteristics of these three contributing terms for an example current commutation duty. Since the instantaneous current and the rate of current change are interdependent with the instantaneous voltage, the characteristics of each term are very sensitive to the switch design.

Equation (1) above permits establishment of a relationship between the system parameters and the required switch voltage for performing current commutation. Because the instantaneous switch voltage involves the instantaneous projectile displacement and speed, as well as the current, a solution generally cannot be obtained without an overall system simulation. However, greatly simplified approximate evaluations can be performed to estimate the magnitude of voltage required and the relative importance of the system parameters.

Figure 5:
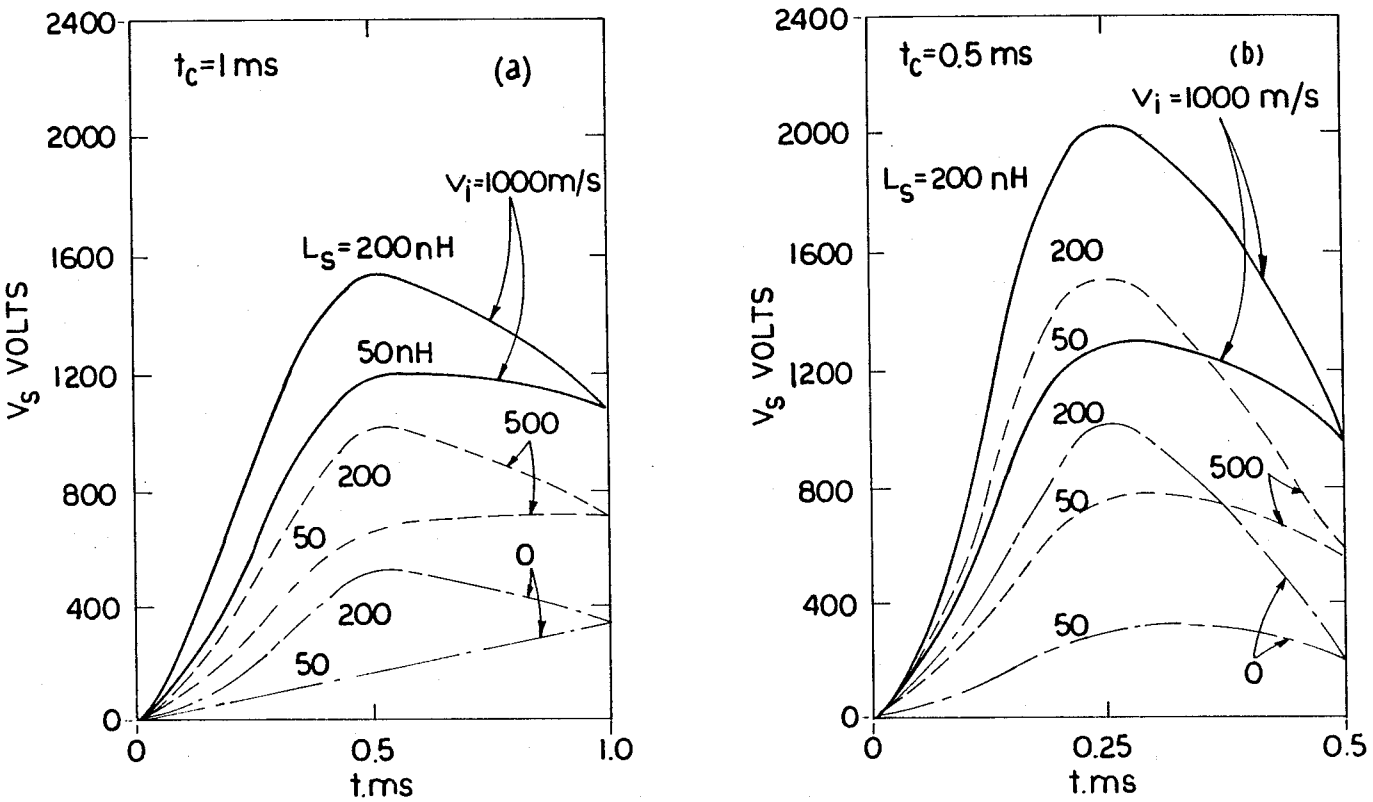
FIG. 5 is a graph illustrating approximate relationships between transient switch voltage and certain fixed parameters for performing current commutation in the launcher of FIG. 1.

FIG. 5 shows the results of an approximate solution of transient switch voltage with fixed system parameters of:

$I_o = 1.5$ MA,
$L' = 0.5$ uH/m,
$L_{bo}$ (initial barrel inductance) $= 0$,
$R = 50$ micro-ohms, and
$a = 10^5$ G, where a is the projectile acceleration at the completion of commutation. Variables are desired commutation time $t_c$, switch inductance $L_s$, and projectile preacceleration speed $v_i$. The approximation involves assuming a linearly increasing commutated current profile for calculating projectile acceleration and a multiplier of 1.6 to the average rate for obtaining the maximum di/dt.

As shown in FIG. 5, both the switch inductance and the projectile preacceleration speed have a major influence on the switch voltage. Reduction of values of one or both parameters can drastically reduce the required switch voltage. For example, in the case of $t_c = 0.5$ ms, a 2000 V peak voltage ($L_s = 200$ nH, $v_i = 1000$ m/s) can be reduced to about 300 V if $L_s$ can be reduced to 50 nH and the commutation can be performed without preacceleration of the projectile. To reduce the commutation voltage requirement and thus the switching duty, both switch design optimization for minimizing inductance and a systems approach to reduce the speed or even eliminate the need for preacceleration before current commutation are essential.

Also shown in FIG. 5 is the pronounced influence of the desired commutation time upon the switch voltage requirement especially the peak value. As can be expected, a shorter commutation time requires a higher peak voltage value.

Even though the influence of commutating loop resistance R is not included in FIG. 5, it can be easily assessed. The dominant factor controlling the value of the loop resistance is the resistance of the armature, including the armature-rail interface resistance. For an armature which is still in the solid phase, the voltage drop for the armature is generally very small (10 V or less). If, on the other hand, a plasma armature is formed during commutation, the armature voltage could be as high as several hundred volts, and an equivalent increase in switch voltage is required. Therefore, retaining the armature in solid phase during commutation is also very effective in reducing the commutating phase duty.

In summary, the voltage requirement during the commutation phase can be substantially reduced by (1) reducing the switch inductance, (2) reducing or eliminating the need for preacceleration prior to commutation, and (3) commutating into a solid armature.

Integrated Switch-Preaccelerator System

Figure 6:
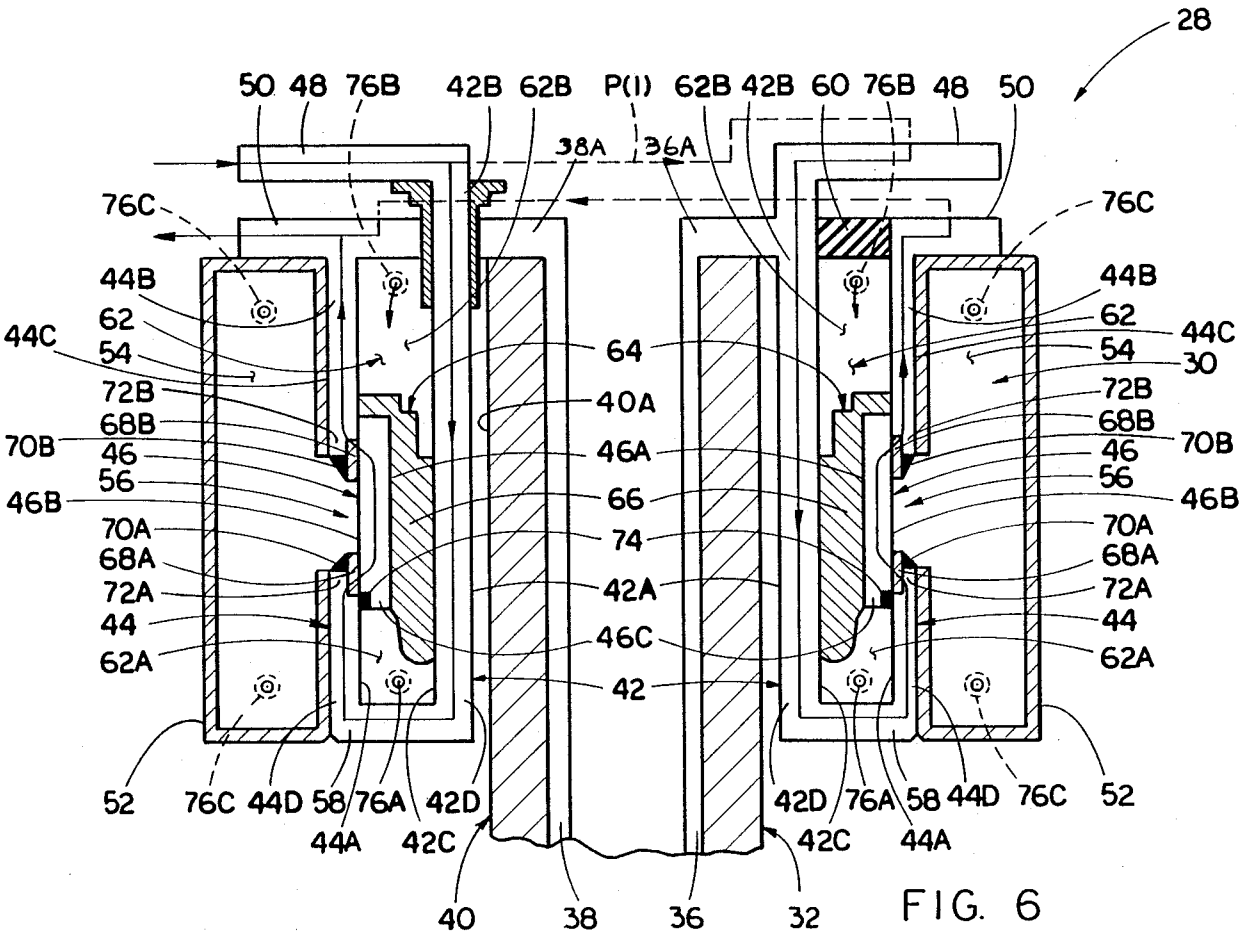
FIG. 6 is an longitudinal axial sectional schematical view of an integrated switch-preaccelerator system of the present invention for use with the launcher of FIG. 1, with the configuration of the system illustrated being that in the conduction phase of a switching operation which immediately precedes the current commutation phase.
Figure 7:
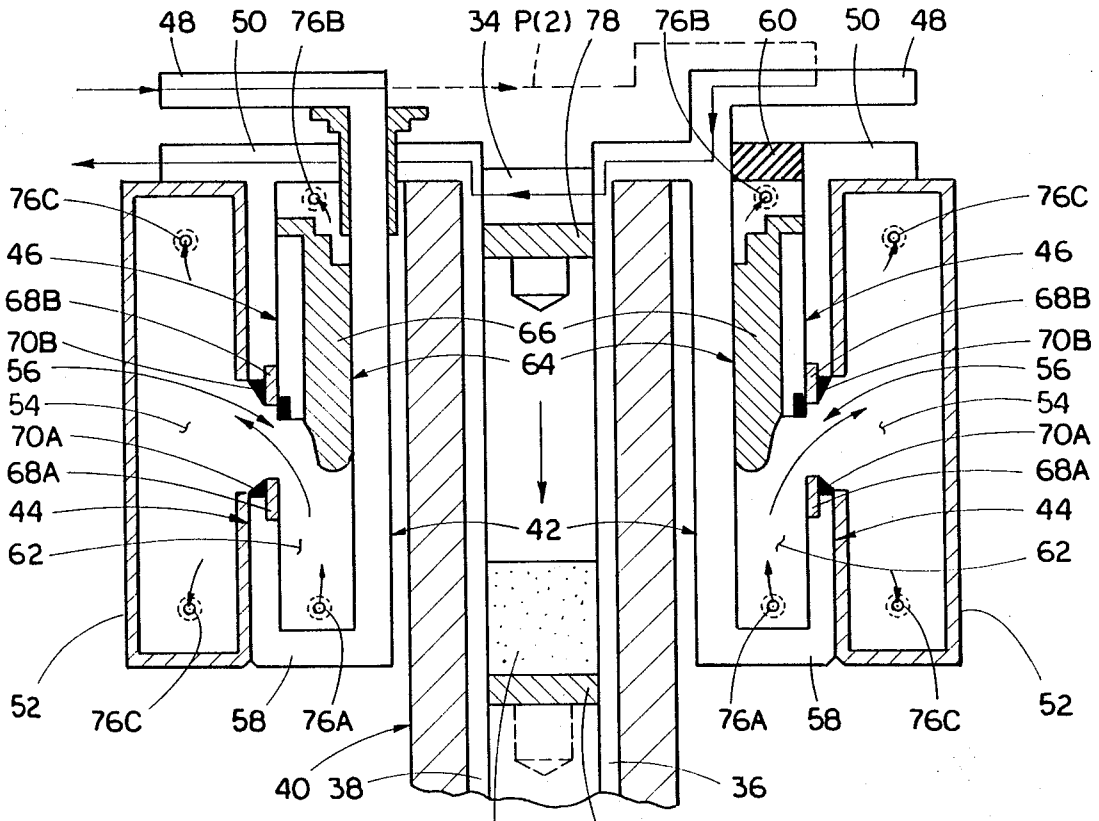
FIG. 7 is a view similar to that of FIG. 6, but with the configuration of the system illustrated being that in the non-conduction phase of the switching operation which immediately succeeds the current commutation phase.

Turning now to FIGS. 6 and 7, there is schematically illustrated an integrated switch-preaccelerator system of the present invention, generally designated 28, for use in the EML 10. The integrated switch-preaccelerator system 28 accomplishes the above-mentioned three tasks for reducing the commutation voltage requirements. The basic concept of the system design is a recognition that (a) the electromagnetic acceleration principle can be used to preaccelerate the projectile, (b) current commutation can be performed in the preacceleration stage with an EML type preaccelerator, (c) a hydrid armature can be provided which stays in solid phase long enough for the projectile armature to reach the required speed before it is vaporized to form a plasma armature, and (d) a coaxial current path minimizes the inductance.

The switch-preaccelerator system 28 is basically an integration of a linear mechanical type electric switch 30 also of the present invention and a rail gun type preaccelerator 32. The switch 30 is operable to commutate current into an essentially stationary solid projectile armature 34 supported between a pair of right and left preaccelerator rails 36,38 in an insulative preaccelerator barrel 40. The preaccelerator rails 36,38 and barrel 40 basically constitute a short EM launcher. The preaccelerator rails 36,38 would be connected directly to the main EML rails 20, 22 (FIG. 1).

More particularly, the switch 30 encloses the preaccelerator barrel 40 and is of a cylindrical configuration. The switch 30 basically includes a plurality of conductive tubular members in the form of three concentric and coaxial conductor tubes 42,44,46 through which current is conducted in opposite directions along a coaxial path. The switch 30 also includes a pair of annular terminal elements or plates 48,50 from and to which the current is conducted to and from the coaxial path.

An inner, first one of the conductor tubes 42 of the switch 30 at an interior surface 42A thereof is mounted about and extends axially along the exterior surface 40A of the insulative preaccelerator barrel 40. At its upstream end 42B, the inner tube 42 is electrically connected to both the upstream one of the terminal plates 48 and the upstream end 36A of the right one of the preaccelerator rails 36.

An outer, second one of the conductor tubes 44 of the switch 30 concentrically surrounds the inner tube 42 and at an interior surface 44A thereof is radially spaced outward from an exterior surface 42C of the inner tube 42. At its upstream end 44B, the outer tube is electrically connected to both the downstream one of the terminal plates 50 and the upstream end 38A of the left one of the preaccelerator rails 38. At its exterior surface 44C, the outer tube supports an annular-shaped hollow insulator housing 52 defining an outer chamber 54. Coextensive short axial sections or portions of the outer tube 44 and insulator housing 52 are cut out or away to form an annular contact gap 56.

The inner and outer tubes 42,44 of the switch 30 at their respective downstream ends 42D,44D are electrically connected by an annular conductive end wall 58, whereas at their respective upstream ends 42B,44B, the inner and outer tubes 42,44 are connected by an annular insulative end wall 60. The inner and outer tubes 42,44 and downstream conductive and upstream insulative opposite end walls 58,60 together define an annular-shaped hollow inner chamber 62. The annular outer and inner chambers 54,62 communicate through the space of the contact gap 56.

A middle, third one of the conductor tubes 46 of the switch 30 is disposed within the annular inner chamber 62 between the inner and outer tubes 42,44, and is movable axially along the inner and outer tubes 42,44. The inner and outer tubes 42,44 are disposed in stationary relative to the accelerator barrel 40. The middle tube 46 is part of a piston assembly 64 and works as a movable bridge contact. The piston assembly 64 also includes an annular insulator body 66. The insulator body 66 is slidably mounted about the exterior surface 42C of the inner tube 42 and, in turn, supports the middle tube 46 at the interior surface 46A thereof. The exterior surface 46B of the middle tube 46 is maintained by the insulator body 66 in contact with the interior surface 44A of the outer tube 44.

The middle tube 46 has an axial length enough longer than the axial length of the contact gap 56 defined in the outer tube 44 to allow it to bridge the contact gap. Both the middle tube 46 and insulator body 66 have axial lengths enough shorter than the axial lengths of the inner and outer tubes 42,44 so as to allow the piston assembly 64 to slidably move between first downstream and second upstream axially displaced positions, as shown respectively in FIGS. 6 and 7, wherein the contact gap 56 is respectively closed and opened. By moving the piston assembly 64 and thereby the middle bridge contact tube 46 between the downstream and upstream positions, a current path P(1) from the upstream terminal plate 48 through the inner tube 42 and therefrom via the downstream conductive end wall 58 through the outer tube 44 to the downstream terminal plate 50, such as depicted by the arrows in FIG. 6, can respectively be electrically completed or interrupted.

For enhancing completion of electrical contact between the middle tube 46 and the outer tube 44 when the middle tube 46 is in its downstream position of FIG. 6, contact means in the form of respective pairs of main annular-shaped contact elements 68A,68B and arcing contact elements 70A,70B are provided. The main contact elements 68A,68B, which conduct current during the conducting phase of switch operation, are required to have a capability of withstanding both high current density and high $I^2t$. An array consisting of brush type contact modules can be used as the main contact elements. To protect them from arc damage, the arcing contact elements 70A,70B are placed at locations where arcing is to be initiated.

More particularly, the main contact and arcing contact elements 68A,70A are located at the downstream (lower) end of the contact gap 56, being fixed to one another and to the corresponding downstream interior edge 72A of the outer tube 44 defining the downstream end of the gap. The main contact and arcing contact elements 68B,70B are located at the upstream (upper) end of the contact gap 56, being fixed to one another and to the corresponding upstream interior edge 72B of the outer tube 44 defining the upstream end of the gap. Also, an annular-shaped arcing contact 74 is fixed on the downstream end 46C of the middle bridge contact tube 46 where arcing is also typically initiated.

Suitable driving means is also provided for moving the piston assembly 64 between its downstream and upstream positions. For example, a pneumatic driving means can be employed in the form of high pressurize gas (e.g., a mixture of $SF_6$ and $N_2$) introduced from a suitable source (not shown) via suitable valve mechanism (not shown) through pluralities of respective orifices 76A,76B, schematically illustrated in FIGS. 6 and 7, provided in the downstream and upstream portions 62A,62B of the inner chamber 62. Also, a plurality of exhaust orifices 76C are provided in the outer chamber 54.

FIGS. 6 and 7 respective illustrate operation of the switch 30 in conducting (pre-commutating) and non-conducting (post-commutating) phases. The transition between the conducting and non-conducting phases is the commutating phase. The commutating phase involves switching or transferring current from the current path P(1) shown in FIG. 6 running from the upstream terminal plate 48 to the downstream terminal plate 50 of the switch 30 by flowing in opposite directions in coaxial path segments through the inner, outer, and middle tubes 42,44,46 to the current path P(2) shown in FIG. 7 running from the upstream terminal plate 48 to the downstream terminal plate 50 through the solid projectile armature 34 and the breech or upstream ends 36A,36B of the preaccelerator rails 36,38.

For operating in the conducting phase of the switching cycle, the pneumatic driving means supplies gas under pressure through upstream orifices 76B communicating with the upstream portion 62B of the inner chamber 62 for actuating by pneumatic force the piston assembly 64 to the downstream position of FIG. 6. The current flow pattern along path P(1) is coaxial and thus has very low inductance. The cylindrical conductor arrangement of the tubes 42,44,46 also provides ample surface for installation of contact modules to attain the low resistance required.

Just prior to initiation of the commutation of the current, the projectile with solid armature 34 is inserted with essentially zero velocity into the breech end 32A of the preaccelerator 32. To initiate commutation of the current, high pressure gas is then introduced through the downstream orifices 76A into the downstream portion 62A of the inner chamber 62 (as gas is allowed to exhaust back through the upstream orifices 76B from the upstream portion 62A thereof). The force of the high pressure gas inflow drives the piston assembly 64 from its downstream position of FIG. 6 toward its upstream position of FIG. 7 and breaks the lower resistance electrical contact interface between the downstream end 46C of the bridge contact middle tube 46 and the main contact element 68A on the interior downstream edge 72A of the outer tube 44 defining the gap 56.

However, concurrently as the contact interface is broken, an electric arc forms across the gap 56 between the downstream arcing contact element 70A on the outer tube interior downstream edge 72A and the arcing contact element 74 on the downstream edge 46C of the middle tube 46. The arc is cooled by the high pressure gas flowing outwardly from the inner chamber 62A through the gap 56 into the outer chamber 54. The magnetic field of the current also provides force to blow the arc outward. These arc cooling and blowing effects produce high arc voltage which performs current commutation and followed by extinguishment of the arc. These effects also enhance the dielectric recovery of the arcing gap once current is commutated. The current flow after commutation, as shown in FIG. 7, indicates that a very low commutation loop inductance, corresponding to the coaxial portion of the current path in FIG. 6, is obtained by this switch arrangement.

During and after current commutation, the projectile armature 34 is being accelerated. The armature 34 is designed such that formation of plasma armature at 34A, e.g., by vaporization of fuse, does not occur until (a) a minimum duration of, for instance, 1 ms has passed since the completion of current commutation and (b) the desired preacceleration speed to the main EML barrel is reached. The current flow time in meeting these conditions is generally short enough that the solid armature does not appreciably raise the mass of the overall launching package.

One example of various dimensions for the integrated switch-preaccelerator system for 1 MA peak current is as follows:

Outer conductor tube dia. = 26 cm
Inner conductor tube dia. = 15 cm
Conductor axial length = 40 cm
Preaccelerator length = 2 m The switch resistance during the conducting phase is calculated as 1 to 2 micro-ohms, and the commutation loop inductance as 40 nH. Using a L′ of 0.5 uH/m, a projectile mass of 500 g, a solid armature mass of 100 g, and a solid armature resistance of 50 micro-ohms, a requirement of commutation voltage peak of approximately 120 V is obtained for commutating the current in 1 ms. The voltage can be generated with a contact moving speed of approximately 10 m/s, which is within the capability of a pneumatic or mechanically operated mechanism.

At the end of commutation, the projectile armature 34 is calculated to be moving at approximately 133 m/s. An additional time of 1 ms is expected to pass before the solid armature 34 is vaporized and plasma armature 34A is formed. At this time the projectile 78 is calculated to be moving at approximately 530 m/s and will have travelled an overall distance of 2 m. Since the preaccelerator rails 36,38 are connected directly to the main EML rails 20,22 (FIG. 1), no further current commutation is required, and the projectile 78 with the plasma armature 34A behind it can enter the main EML breech at an injection speed of 530 m/s.

In summary, the major advantages of the integrated switch-preaccelerator system 26 of the present invention are as follows. First, current commutation can be performed with substantially low switch voltage, thus reducing substantially the switching severity and its associated problems such as arc energy dissipation, contact erosion and insulating material damages. These benefits should increase substantially the life of the switch. The low voltage requirements also permits use of linear mechanical switch components with moderate contact operating speeds. Second, because of current commutation to an essentially stationary armature, precise timing between the actuation of the preaccelerator 32 and the switch 30 is not as critical as using conventional preaccelerator and switch schemes. This reduces substantially the design problems of the operating mechanism. Third, a high preacceleration speed can be obtained with relatively short axial barrel length. Fourth, the integrated design is inherently more compact and lightweight and thus more suitable for weaponization.

It is thought that the present invention and many of its attendant advantages will be understood from the foregoing description and it will be apparent that various changes may be made in the form, construction and arrangement thereof without departing from the spirit and scope of the invention or sacrificing all of its material advantages, the form hereinbefore described being merely a preferred or exemplary embodiment thereof.

I claim:

1. An integrated switch-preaccelerator system for use in an electromagnetic launcher, said system comprising:

(a) a pair of spaced generally parallel preaccelerator rails; and (b) a linear mechanical switch of cylindrical configuration enclosing and extending axially along said rails, said switch being operable to commutate current from a first path wherein current flows through said switch in opposite directions along path segments spaced from one another and coaxially arranged about said rails to a second path wherein current flows across said rails through a solid armature being supported between said preaccelerator rails;

(c) said switch including a plurality of coaxially arranged conductive tubular members enclosing and extending axially along said rails, one of said tubular members being movable relative to the other of said tubular members from conducting to non-conducting positions for causing said switch to commutate current from said first to second paths.

2. An integrated switch-preaccelerator system for use in an electromagnetic launcher, said system comprising:

(a) a pair of spaced generally parallel preaccelerator rails;

(b) a pair of spaced first and second conductive switch terminal elements disposed adjacent upstream ends of said rails; and (c) a plurality of coaxially arranged conductive tubular members enclosing and extending axially along said rails, one of said tubular members being movable relative to the other of said tubular members between conducting and non-conducting positions;

(d) said terminal elements and selected ones of said tubular members being electrically connected together such that movement of said one tubular member from its conducting position to non-conducting position causes operation of said switch to commutate current from a first path wherein current flows from said first terminal element to second terminal element by flowing through said tubular members in opposite directions along path segments spaced from and coaxially arranged about one another to a second path wherein current flows from said first terminal element to second terminal element by flowing through portions of said rails and a solid armature being supported between said rails and bypassing said tubular members.

3. The system as recited in claim 2, wherein said plurality of tubular members includes inner, outer and middle conductor tubes concentrically and coaxially arranged with one another.

4. The system as recited in claim 3, wherein said inner conductor tube at an interior surface thereof is mounted about and extends axially along said preaccelerator rails.

5. The system as recited in claim 4, wherein said inner conductor tube at its upstream end is electrically connected to both an upstream one of said terminal elements and the upstream end of one of said preaccelerator rails.

6. The system as recited in claim 5, wherein said outer conductor tube concentrically surrounds said inner tube and at an interior surface thereof is radially spaced outward from an exterior surface of said inner tube.

7. The system as recited in claim 6, wherein said outer conductor tube at its upstream end is electrically connected to both a downstream one of said terminal elements and the upstream end of the other of said preaccelerator rails.

8. The system as recited in claim 7, further comprising:

an annular-shaped hollow insulator housing defining an outer chamber and being supported about said outer conductor tube at its exterior surface.

9. The system as recited in claim 8, wherein said outer tube and insulator housing have axial portions thereof cutaway to form an annular contact gap therein.

10. The system as recited in claim 9, wherein said inner and outer tubes at their respective downstream ends are electrically connected by an annular conductive end wall.

11. The system as recited in claim 10, wherein said inner and outer tubes at their respective upstream ends are connected by an annular insulative end wall such that said inner and outer tubes and said conductive downstream and insulative upstream opposite end walls together define an annular-shaped hollow inner chamber.

12. The system as recited in claim 11, wherein said annular outer and inner chambers communicate through said contact gap.

13. The system as recited in claim 12, wherein said middle conductor tube is disposed within said annular inner chamber between said inner and outer tubes and is movable axially therealong.

14. The system as recited in claim 13, wherein said inner and outer tubes are disposed in stationary relative to said preaccelerator rails.

15. The system as recited in claim 14, wherein said middle tube is part of a piston assembly movable axially within said inner chamber and operable as a movable bridge contact.

16. The system as recited in claim 15, wherein said piston assembly also includes an annular insulator body.

17. The system as recited in claim 16, wherein said insulator body is slidably mounted about said exterior surface of said inner tube and, in turn, supports said middle tube at its interior surface.

18. The system as recited in claim 17, wherein said middle tube at its exterior surface is maintained by said insulator body in contact with said outer tube at its interior surface.

19. The system as recited in claim 18, wherein said middle tube has an axial length enough longer than the axial length of said contact gap defined in said outer tube to allow said middle tube to bridge said contact gap.

20. The system as recited in claim 19, wherein both of said middle tube and insulator body have axial lengths enough shorter than the axial lengths of said inner and outer tubes so as to allow said piston assembly to slidably move between first and second axially displaced positions wherein said contact gap is respectively closed and opened.

21. The system as recited in claim 20 wherein by moving said piston assembly and thereby said middle bridge contact tube therewith between said first and second positions said first current path from said one terminal element in one axial direction through said inner tube, therefrom across said downstream conductive end wall to said outer tube, and in an opposite axial direction through said middle and outer tubes to said other terminal element can respectively be electrically completed or interrupted.

22. The system as recited in claim 21, further comprising:

a pair of main annular-shaped contact elements; and a pair of arcing contact elements;

said main contact elements and arcing contact elements being located at downstream and upstream opposite ends of said contact gap and being fixed to one another and to the corresponding downstream and upstream interior opposite edges of said outer tube defining said gap.

23. The system as recited in claim 22, further comprising:

an annular-shaped arcing contact being fixed on the downstream end of said middle tube where arcing occurs when said middle tube is moved to interrupt said first current path.

24. The system as recited in claim 16, further comprising:

driving means for moving said piston assembly from its first position to its second position.

25. The system as recited in claim 2, wherein said driving means is a high pressure gas introduced into said inner chamber from a source thereof so as to cause movement of said piston assembly from its first to second positions whereupon said gap is opened allowing said gas to flow through said gap into said outer chamber and extinguish an electric arc formed across said gap between said outer tube and said moving middle tube of said piston assembly.

* * * * *